United States Patent [19]

Somerville

[11] 4,384,674

[45] May 24, 1983

[54] SELF-CLEANING NOZZLE

[75] Inventor: Grant J. Somerville, Ancaster, Canada

[73] Assignee: AMCA International Limited, Brantford, Canada

[21] Appl. No.: 271,706

[22] Filed: Jun. 8, 1981

[51] Int. Cl.[3] ..... B05B 15/02

[52] U.S. Cl. ..... 239/118

[58] Field of Search ..... 239/118, 109

[56] References Cited

U.S. PATENT DOCUMENTS

| | | | |
|---|---|---|---|
| 1,879,363 | 9/1932 | Loepsinger | 239/118 |
| 2,614,885 | 10/1952 | Roell | 239/118 |
| 4,283,012 | 8/1981 | Hanson | 239/118 |

*Primary Examiner*—John J. Love
*Assistant Examiner*—Jon M. Rastello

[57] ABSTRACT

A self-cleaning nozzle includes a piston with a cleaning tip slidably mounted in the interior of a cylinder having two ends and a side wall, the cylinder having first, second and third openings into its interior, the second opening being intermediate the first and third openings. First and second sources of fluid are provided, the former communicating in fluid-flow relationship with the piston and the interior of the cylinder via the second opening. The second source communicates in fluid-flow relationship with the piston and the interior of the cylinder via the third opening. When the force exerted by the pressure of the second source is greater than the force exerted by the pressure of the first source, the piston moves to the cleaning position where the cleaning tip is passed into the first opening, cleaning out any foreign object therein. When the force exerted by the pressure of the first source is greater than the force exerted by the pressure of the second source, the piston is moved out of the cleaning position, and fluid from the first source flows into the interior of the cylinder and out of the nozzle via the first opening. The piston blocks the flow of fluid between the two sources in either of its positions.

3 Claims, 3 Drawing Figures

SELF-CLEANING NOZZLE

BACKGROUND OF THE INVENTION

Nozzles through which fluids are supplied may become blocked from time-to-time with foreign materials in the fluid. For example, pulpwood grinding equipment commonly employs stone showers provided with what are usually referred to as nozzles. From time-to-time foreign matter will block the nozzles, creating the need for cleaning of the same, since plugged nozzles can result in serious damage to the equipment intended to be showered by the nozzles.

Self-cleaning nozzles are known. For example, reference may be made to the following U.S. Pat. Nos. 2,186,214, H. F. Simon, Jan. 9, 1940; 1,789,625, A. M. Goodloe, Jan. 20, 1931; 2,614,885, W. J. Roell et al, Oct. 25, 1952; 4,248,381, John B. Vessels, Feb. 3, 1981; and 2,311,018, A. H. Bahnson, Jr., Feb. 16, 1943. The nozzles or other devices shown in these patents are subject to one or more of the following disadvantages: mechanical complexity, employed of diaphragms and springs that can weaken and fail and use of a large number of parts.

In accordance with an aspect of this invention, there are provided nozzles which avoid the aforementioned disadvantages.

SUMMARY OF THE INVENTION

According to one aspect of the present invention there is provided a self-cleaning nozzle comprising a cylinder having first and second ends, a side wall and a hollow interior, said cylinder having first, second and third openings therein extending into said interior thereof, said second opening being located intermediate said first and third openings, said first opening when open communicating in fluid-flow relationship with said interior of said cylinder, a piston slidably mounted in said interior of said cylinder, said piston including a cleaning tip that is movable into said first opening to clean said first opening when said piston is moved from a first position in said cylinder to a second position in which said cleaning tip is inserted into said first opening, a first source of fluid under pressure, a second source of fluid, means for varying the pressure of the fluid of said second source between a first pressure and a second pressure, said first source of fluid communicating in fluid-flow relationship with said interior of said cylinder via said second opening and exerting a force tending to move said piston in a first direction, said second source of fluid communicating in fluid-flow relationship with said interior of said cylinder via said third opening and exerting a force tending to move said piston in a second direction opposite to said first direction, said piston being constructed and arranged such that when said pressure of said second source is at said first pressure the force exerted by the pressure of said second source on said piston is greater than the force exerted by the pressure of said first source on said piston and said piston moves to said second position thereof and when said pressure of said second source is at said second pressure the force exerted by the pressure of said second source on said piston is less than the force exerted by the pressure of said first source on said piston and said piston moves to said first position thereof where said cleaning tip is withdrawn from said first opening, the pressure of said first source of fluid and the pressure of said second source of fluid acting on said piston being the sole means for moving said piston in said first and second directions, in said first position of said piston said first source of fluid communicating in fluid-flow relationship with said interior of said cylinder and thereby with said first opening, whereby fluid from said first source is ejected through said first opening, in both positions of said piston said piston blocking flow of fluid between said first and second sources.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENT

Figure 1:
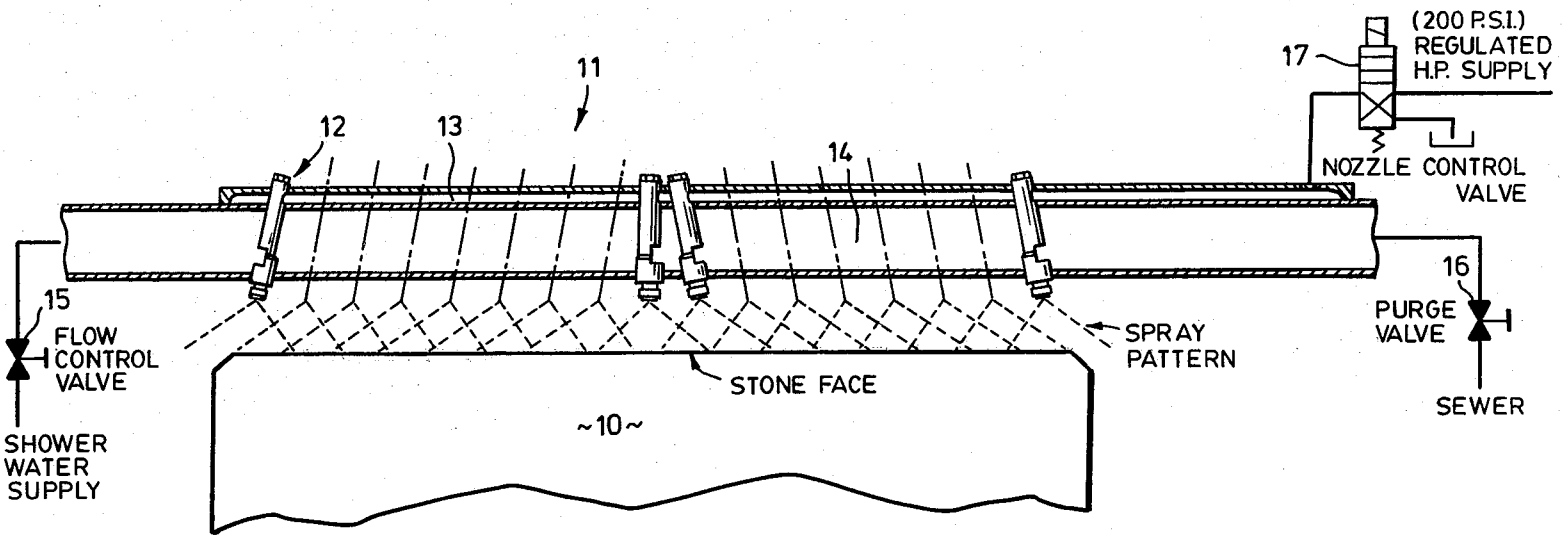
FIG. 1 is a section through pulpwood grinding equipment employing nozzles embodying the instant invention, portions of the equipment being shown schematically and only a part of the pulpwood grinding stone being illustrated.

Referring first to FIG. 1, the pulpwood grinding equipment shown therein includes a conventional grinding stone 10 and shower apparatus generally designated 11. The shower apparatus includes nozzles 12 embodying the instant invention and two ducts or headers 13 and 14.

Header 14 is connected at one end via a flow control valve 15 to a shower water supply, while the other end thereof is connected via a purge valve 16 to a sewer.

Header 13, on the other hand, is connected via a nozzle control valve 17 to either a regulated high pressure supply of any suitable fluid, e.g., water or to a sewer.

In the arrangement shown in FIG. 1 four nozzles are provided and are located and arranged in the positions indicated in the Figure. This is not critical to the instant invention, and different numbers of nozzles may be employed, and they may be arranged and configured in different ways.

Figure 3:
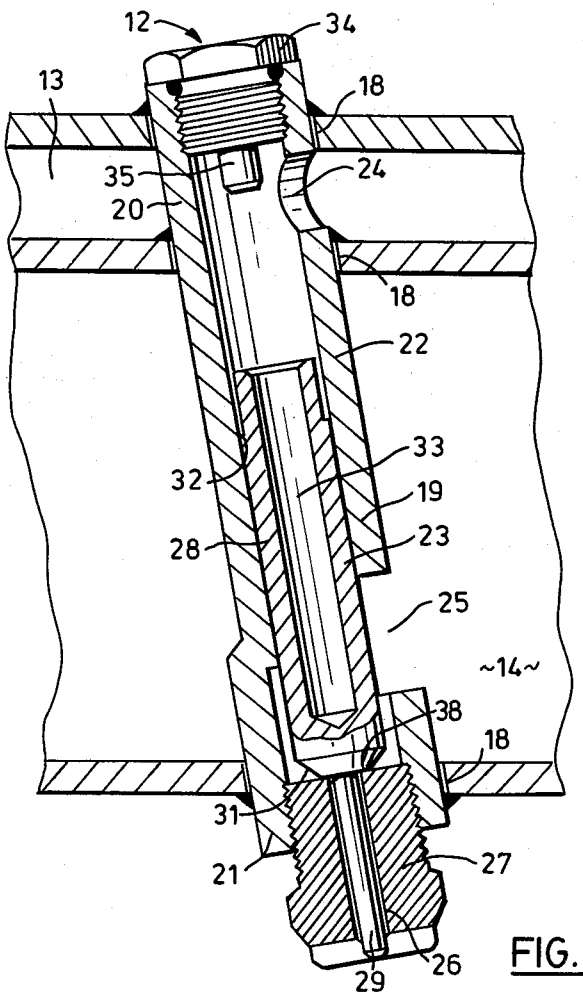
FIGS. 2 and 3 are longitudinal sections through a self-cleaning nozzle embodying the instant invention showing the nozzle in the operating mode (FIG. 2) and in the cleaning mode (FIG. 3).
Figure 2:
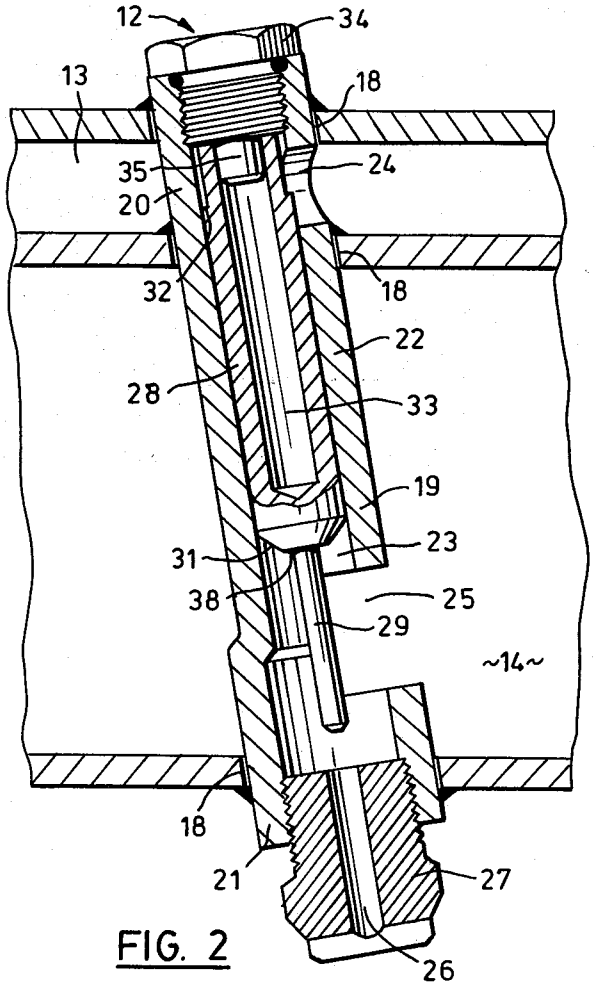

As best shown in FIGS. 2 and 3, openings 18 are provided in the walls that define headers 13 and 14, and nozzles 12 are accommodated in these openings being secured to the walls defining the headers in any convenient way, e.g., by welding.

Each self-cleaning nozzle includes a cylinder 19 that has ends 20 and 21, a side wall 22 which, in the embodiment illustrated, is of annular configuration, and a hollow interior 23.

Cylinder 19 has three openings 24, 25 and 26 extending into interior 23 thereof, opening 25 being located intermediate openings 24 and 26. Opening 26 actually is provided in a cylindrical member 27 that is threaded into engagement with side wall 22 at end 21 thereof, but this is not essential to the instant invention, and opening 26 may be provided in an end wall of cylinder 19 formed integral with side wall 22.

A piston 28 is slidably mounted in the interior 23 of cylinder 19. In the embodiment of the invention illustrated, piston 28 is cylindrical in configuration, the cross-sectional shape of piston 28 being dictated by the cross-sectional shape of the interior 23 of cylinder 19.

Piston 28 includes a cleaning tip 29 that is movable into opening 26 to clean that opening when piston 28 is moved from the position shown in FIG. 2, which is the operating mode of the nozzle, to the position shown in FIG. 3, which is the cleaning position of the nozzle. It will be appreciated that the effect of cleaning tip 29 moving into opening 26 is to force out through the opening any foreign particle that may have become lodged in opening 26.

It will be noted that piston 28 is provided with a chamfer at 31 and with a stepped surface 32. Also the interior of piston 28 is hollow, being provided with a cylindrical bore 33.

The upper end of cylinder 29 has a cap 34 threadably engaged therewith and provided with a pin or projection 35 that is slightly smaller in diameter than the diameter of bore 33, pin 35 fitting into bore 33 in the position of piston 28 shown in FIG. 2 with some clearance provided between pin 35 and the walls of bore 33.

Shower water at a pressure of, say, 150 p.s.i. is supplied to header 14 via flow control valve 15 (FIG. 1), from the shower water supply. Purge valve 16 is closed, of course.

In the operating mode piston 28 is in the position shown in FIG. 2, so that the shower water enters cylinder 19 via opening 25 and passes from the interior 23 of cylinder 19 through opening 26 to be ejected onto stone 10 (FIG. 1).

When it is desired to clean nozzle 12, fluid under pressure is introduced into header 13 by moving nozzle control valve 17 (FIG. 1) so that it is connected to a source of regulated high pressure fluid, say, water at 200 p.s.i. This high pressure fluid acting first on step 32 and then subsequently on the whole upper end surface of piston 28 and the surface defining bore 33 exerts a force which is sufficient to overcome the force which is exerted by the pressure of the shower water acting on chamfered surface 31, the annular surface 38 immediately adjacent thereto and between chamfered surface 31 and pin 29 and the end surface of pin 29, with the result that piston 28 is forced to move from the position thereof shown in FIG. 2 to the position thereof shown in FIG. 3. As previously explained, when this occurs, tip 29 moves through opening 26 cleaning any foreign material therefrom.

The procedure is reversed by moving nozzle control valve 17 (FIG. 1) to a position wherein header 14 is disconnected from the regulated high pressure supply and is connected to a sewer at atmospheric pressure, i.e., the same pressure as that to which opening 26 exits. Under these circumstances, the pressure of the shower water acting on chamfered surface 31 and then on annular surface 38 adjacent thereto and finally on the end of cleaning tip 29 produces a force which moves piston 28 from the position thereof shown in FIG. 3 to the position thereof shown in FIG. 2. Any mechanical shock which might be created as a result of this movement is cushioned by pin 35 being injected into bore 33 causing the displacement of water from bore 33 and thus preventing any sudden impact between piston 28 and cap 34.

As may be seen from FIGS. 2 and 3, in either position of piston 28 it prevents the flow of fluid between headers 13 and 14.

While, in the embodiment of the invention hereinbefore described, the fluid supplied to header 13 was indicated as being at a higher pressure than the pressure of the shower water supplied to header 14, this is not absolutely essential to the invention. It is well known that $F=P\times A$, where F stands for force, P stands for pressure, and A stands for the area on which the pressure acts. What is necessary, when the nozzle is going from the operating mode to the cleaning mode, is that the force acting downwardly on the piston exceed the force acting upwardly on the piston, the opposite being true when the nozzle is to be changed from the cleaning mode to the operating mode. These objectives can be achieved by varying the areas acted upon by the fluids in headers 13 and 14 and/or by varying the pressures of these fluids.

While a preferred embodiment of the invention has been described herein, those skilled in the art will appreciate that changes and modifications may be made therein without departing from the spirit and scope of the invention as defined in the appended claims.

The embodiments of the invention in which an exclusive property or privilege is claimed are defined as follows:

1. A self-cleaning nozzle comprising a cylinder having first and second ends, a side wall and a hollow interior, said cylinder having first, second and third openings therein extending into said interior thereof, said second opening being located intermediate said first and third openings, said first opening when open communicating in fluid-flow relationship with said interior of said cylinder, a piston slidably mounted in said interior of said cylinder, said piston including a cleaning tip that is movable into said first opening to clean said first opening when said piston is moved from a first position in said cylinder to a second position in which said cleaning tip is inserted into said first opening, a first source of fluid under pressure, a second source of fluid, means for varying the pressure of the fluid of said second source between a first pressure and a second pressure, said first source of fluid communicating in fluid-flow relationship with said interior of said cylinder via said second opening and exerting a force tending to move said piston in a first direction, said second source of fluid communicating in fluid-flow relationship with said interior of said cylinder via said third opening and exerting a force tending to move said piston in a second direction opposite to said first direction, said piston being constructed and arranged such that when said pressure of said second source is at said first pressure the force exerted by the pressure of said second source on said piston is greater than the force exerted by the pressure of said first source on said piston and said piston moves to said second position thereof and when said pressure of said second source is at said second pressure the force exerted by the pressure of said second source on said piston is less then the force exerted by the pressure of said first source on said piston and said piston moves to said first position thereof where said cleaning tip is withdrawn from said first opening, the pressure of said first source of fluid and the pressure of said second source of fluid acting on said piston being the sole means for moving said piston in said first and second directions, in said first position of said piston said first source of fluid communicating in fluid-flow relationship with said interior of said cylinder and thereby with said first opening, whereby fluid from said first source is ejected through said first opening, in both positions of said piston said piston blocking flow of fluid between said first and second sources.

2. A self-cleaning nozzle according to claim 1 wherein said first pressure is higher than the pressure of said first source and said second pressure is lower than the pressure of said first source.

3. A self-cleaning nozzle according to claim 1 wherein said piston has a cavity therein into which fluid from said second source flows, said cylinder including a projection that slides loosely into said cavity when said piston moves into said first position displacing fluid therefrom and cushioning said piston.

* * * * *